United States Patent [19]

Coubrough

[11] 3,939,902

[45] Feb. 24, 1976

[54] HEAT EXCHANGER RIM AND HUB WITH L-SHAPED CROSS-SECTION

[75] Inventor: Lawrence E. Coubrough, Golden, Colo.

[73] Assignee: Coors Porcelain Company, Golden, Colo.

[22] Filed: Feb. 5, 1975

[21] Appl. No.: 547,304

[52] U.S. Cl. ..... 165/8; 165/10

[51] Int. Cl.[2] ..... F28D 19/00

[58] Field of Search ..... 165/8, 9, 10

[56] References Cited

UNITED STATES PATENTS

| | | | |
|---|---|---|---|
| 3,192,999 | 7/1965 | Stockman | 165/9 |
| 3,251,403 | 5/1966 | Smith | 165/10 |

*Primary Examiner*—Albert W. Davis, Jr.
*Attorney, Agent, or Firm*—Reising, Ethington, Barnard, Perry & Brooks

[57] ABSTRACT

In accordance with the invention there is provided a heat exchanger for transferring heat from the exhaust gases of a turbine engine to the intake air for the engine, the heat exchanger comprising a rotatable cylindrical ceramic body having axially extending passages therethrough for passage of the exhaust gases in one direction on one diametric half of the body and for passage of the intake air in the other direction on the other diametric half of said body, one axial end of the body thereby being at a higher temperature than the other axial end of the body, an annulus of ceramic bordering a cylindrical surface of the body and having a radially extending annular flange bonded to the cylindrical surface of the body at the low temperature axial end thereof, there being an annular gap between the ceramic annulus and the cylindrical surface of the body at the high temperature axial end thereof and an annulus of resilient sealing material in the annular gap.

7 Claims, 2 Drawing Figures

HEAT EXCHANGER RIM AND HUB WITH L-SHAPED CROSS-SECTION

Figure 1:
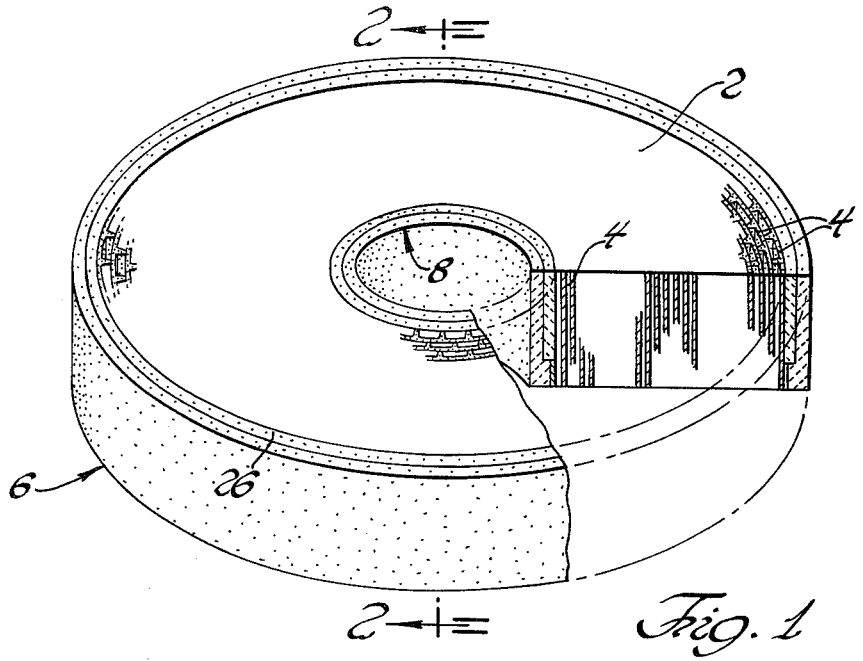

The subject matter of the present invention is an improved cylindrical rotatable ceramic heat exchanger for use in transferring heat from the hot exhaust gases of a gas turbine engine to the intake air for the engine. More specifically, the subject matter of the present invention is an improved structure for the rim or hub, or both, of such a heat exchanger in order to eliminate or minimize failure because of the differential in temperature, and hence the differential in thermal expansion, between the hot axial end of the heat exchanger and the cold axial end thereof.

For many years now it has been proposed to use gas turbine engines in automotive ground vehicles such as trucks, buses and even non-commercial passenger automobiles. One reason why such proposals are attractive is that gas turbine engines simplify the problem of reducing harmful exhaust emissions. However, gas turbine engines present a different problem with respect to the use thereof in ground automotive vehicles. The problem stems from the high heat of the exhaust emitted from the turbine. The high-heat exhaust creates a danger and, of equal importance, results in inefficiency because of the great heat loss. It has long been proposed to correct this problem by means of a rotating cylindrical cellular ceramic heat exchanger, the hot exhaust gases being caused to pass through the heat exchanger on one diametric side thereof and in one axial direction as the heat exchanger rotates, and the incoming air to the gas turbine being caused to pass through the heat exchanger on the other diametric side thereof, and in the other direction, to thereby transfer heat from the exhaust gases to the intake air. Hence, not only are the exhaust gases cooled but the heat removed therefrom is utilized to pre-heat the incoming air fed into the engine. Ceramic is selected as the material for such heat exchangers because of its high heat resistance, low thermal conductivity, and high heat capacity. Typical of the ceramics used are alumina ceramic, mullite and cordierite.

It is desirable, of course, that the cellular ceramic body present minimum resistance to the flow of the exhaust gases and the intake air axially therethrough which, in turn, dictates that the cell walls be relatively thin. This results in a relatively fragile structure and for this and other reasons it is desirable that the cylindrical cellular ceramic body be provided with a rim and a hub of relatively dense ceramic of relatively high mechanical strength. The hub or the rim, generally the latter, is either itself usually formed with circumferentially arranged axially extending gear teeth to enable a driven matching gear to cause rotation of the heat exchanger or, alternatively, a metal annulus with the gear teeth formed thereon can be suitably bonded or otherwise secured to the ceramic rim or hub to provide means for rotating the heat exchanger. But whatever the means used for causing rotation of the heat exchanger a problem arises by reason of the temperature differential between that axial end of the heat exchanger which constitutes the entrance for the hot exhaust gases and the exit for the incoming air and the other axial end of the heat exchanger which constitutes the exit for the exhaust gases and the intake for the incoming air. For example, the hot axial end of the heat exchanger might typically be at a temperature of 1400°F whereas the cold axial end of the heat exchanger might typically be at 400°F. Hence, the hot axial end undergoes greater thermal expansion in a radial direction than does the cold axial end of the heat exchanger. In short, the temperature differential with resultant differential in thermal expansion tends to cause the cellular ceramic body to assume the shape of a lampshade i.e. a concave frusto-conical shape. On the other hand, the ceramic rim and hub, because they are not directly, and to such full extent as the cellular body, subject to the hot gases at the one end or to the cool gases at the other end, tend to maintain their cylindrical shape. This results in significant mechanical stress putting portions of the rim and hub into tension, and this mechanical stress along with that on the cellular body itself can be sufficient to cause failure of the ceramic.

It is an object of the present invention to provide a heat exchanger of the type described wherein means are provided to better assure against rim or hub failure due to differences in thermal expansion. More specifically, it is an object of the present invention to provide a heat exchanger of the type described wherein means are provided to enable radial expansion of the hot axial end of the heat exchanger cellular body without thereby placing the rim or hub of the heat exchanger under such mechanical stress as would cause cracking or other failure.

Briefly, these objects are accomplished in accordance with the invention by a heat exchanger of the type described but wherein the rim and/or hub comprises a ceramic annulus having a radially extending annular flange bonded to the cylindrical surface of the cellular body at the low temperature axial end thereof, there being an annular gap between the ceramic annulus and the cylindrical surface of the cellular body at the high temperature axial end thereof and the annulus of resilient sealing material in the annular gap. The resiliency of the sealing material in the gap allows radial expansion of the cellular body at the hot end without thereby placing stress on the ceramic annulus or on the cellular body itself.

Figure 2:
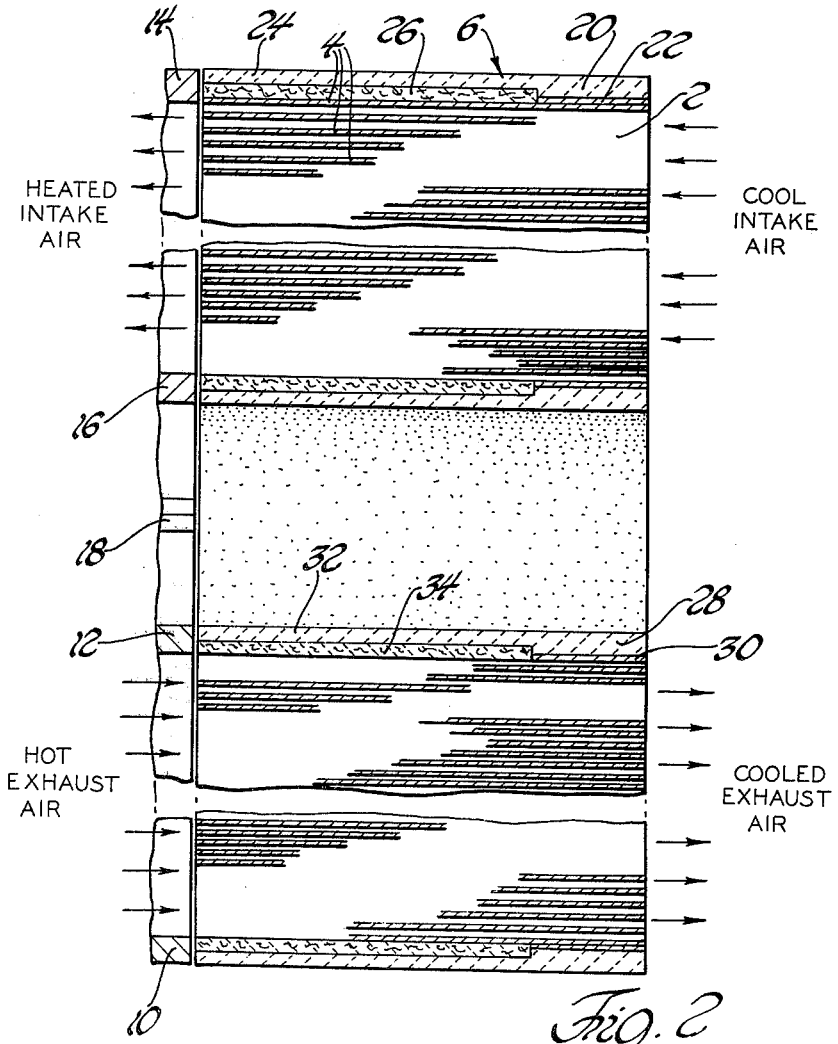

The above and other objects, features and advantages of the invention will appear more clearly from the following detailed description of a preferred embodiment thereof made with reference to the accompanying drawings in which:

FIG. 1 is a perspective view with parts broken away of a preferred embodiment of the invention; and FIG. 2 is a view taken on the line 2—2 of FIG. 1.

Referring now to the drawings, the heat exchanger shown comprises a cylindrical cellular ceramic body 2, the cells constituting axially extending passages 4 from one end to the other end of the body. The heat exchanger has a rim 6 comprising a dense ceramic annulus bordering and bonded to the outer cylindrical surface of the cellular body and a hub 8 comprising a dense ceramic annulus bordering and bonded to the inner cylindrical surface of the cellular body. The ceramic can, for example, be any of those mentioned above, cordierite generally being preferred for both the cellular body and for the rim and hub.

In operation, the cylindrical heat exchanger is mounted to the gas turbine engine such that the hot exhaust gases are caused to pass through the heat exchanger on one diametric side thereof and in one axial direction, and the intake air is caused to pass through the heat exchanger in the opposite axial direction and on the other diametric side thereof. Means such as gear teeth (not shown) on the rim or hub are provided to enable relatively slow rotation of the heat exchanger as the exhaust gases and intake air pass therethrough. Hence, heat is absorbed from the hot exhaust gases by the heat exchanger on one diametric side thereof, and this heat is transferred to the incoming air on the other diametric side of the heat exchanger. It will be understood, of course, that a pair of conduits, each of generally semi-cylindrical shape, are provided on one side of the heat exchanger (on the left side as the heat exchanger is shown in FIG. 2), to conduct the hot exhaust gases to the heat exchanger on the one diametric side thereof (the bottom side of the heat exchanger as it is shown in FIG. 2) and to conduct away from the heat exchanger, and to the engine, the heated intake air exiting from the other diametric side (the top side as the heat exchanger is shown in FIG. 2) of the heat exchanger. The outer and inner walls of the semi-cylindrical conduit for the hot exhaust gas are depicted at 10 and 12, respectively, and the outer and inner walls of the semi-cylindrical conduit for the heated intake air are depicted at 14 and 16, respectively. The diametric wall separating the two semi-cylindrical conduits is depicted at 18. As is well known in the art, suitable seals can be provided between the ends of the conduit walls and the rotating heat exchanger in order to minimize the escape of the exhaust gas and incoming air from between the conduits and the rotating heat exchanger, commensurate with relatively low friction rotation of the heat exchanger with respect to the conduits. The structure of the seals and the conduits form no part of the present invention.

Referring now in particular to FIG. 2, it will be manifest that there will be a significant temperature differential between the two axial ends of the cellular ceramic body 2. That is, the left hand (as shown) axial end of the cellular ceramic body will be relatively hot whereas the right hand end (as shown) will be relatively cool. Since the ceramic composition of the cellular body is uniform from one axial end to the other thereof, this temperature differential in turn means that the hot axial end of the cellular body will undergo greater radial thermal expansion than will the cold end of the body. Absent the present invention this differential in thermal expansion would put portions of the rim into tension by forcing, or tending to force, the axial end thereof at the hot end of the heat exchanger to assume a larger diameter. Likewise, and though not as significant a problem because of the smaller diametric dimension involved, the difference in thermal expansion would, absent the present invention, likewise put portions of the hub into tension by forcing, or tending to force, the diameter of the hub at the hot end of the heat exchanger to assume a smaller diameter. Absent the present invention, it is the mechanical stress thus imposed on the rim and hub, and also the stress on the cellular body itself, which can cause failure of the ceramic, failure at the rim being the most acute problem.

In accordance with the present invention, the ceramic rim 4 has a radially inwardly extending annular flange 20 which is bonded to the cylindrical outer surface of the cellular body 2 at the cold end thereof by a bonding material 22. Calcium aluminate or ordinary glazing material such as a glass or the like conventionally used to bond ceramics can be used as the bonding material though, if desired, a relatively resilientbonding material such as silicone rubber can be used. By reason of the radially inwardly extending flange 20 the other axial end portion 24 of the annular ceramic rim is radially spaced from the cellular ceramic body thereby providing an annular gap between the hot axial end of the cellular ceramic body and the rim portion 24. The length of the gap, axially of the cellular body, should preferably be from about 25% to 50% of the axial thickness of the body. The thickness of the gap need only be sufficiently large to accommodate the amount of radial expansion of the ceramic body anticipated, taking into account that the gap also accommodates packing to seal the gap. A gap thickness of from about ⅛ to ¼ inch is typical.

Filling the annular gap is an annulus 26 of resilient sealing material to prevent or inhibit the escape of exhaust gas or air through the gap. Suitable as the resilient sealing material for the gap are mullite fiber, or fibrous alumina. Alternatively, a ceramic powder pack or potting compound can be used, for example packed magnesium oxide powder.

It is preferred that the rim and its flange 20 be a unitary or monolithic body as shown; however, the flange can, if desired, be a separate ceramic annulus bonded to the outer portion of the rim, the important point being that the rim construction be such as to provide the annular gap at the hot axial end of the cellular body.

As alluded to above, the hub of such a heat exchanger does not present as serious a problem as does the rim. However, the invention can be used for the hub and hence, further in accordance with the invention, the hub shown has a radially outwardly extending annular flange 28 which is glazed or otherwise bonded to the inner cylindrical surface of the cellular ceramic body at the cold end thereof as shown at 30. The hub portion 32 adjacent the hot axial end is radially spaced from the inner cylindrical surface of the cellular body at the hot end thereby providing the annular gap which is filled with an annulus 34 of resilient material, as aforesaid, to provide a seal. Just as in the case of the rim, so also the hub can be of separate ceramic parts bonded together though it is preferred that it be a unitary annular body.

In operation, the greater radial thermal expansion of the hot end of the cellular ceramic body places substantially no mechanical stress on the rim, or on the hub, this because such radial expansion is against the resilient sealing material within the annular gaps, the resiliency of the material enabling deformation thereof such that substantially no mechanical force is applied to the rim or hub portions at the hot axial end of the heat exchanger.

It will be understood that while the invention has been described with reference to a preferred embodiment thereof, various changes may be made all within the full and intended scope of the claims which follow.

The embodiments of the invention in which an exclusive property or privilege is claimed are defined as follows:

1. A heat exchanger for use in transferring heat from the exhaust gases of a turbine engine to the intake air for the engine, said heat exchanger comprising a rotatable cylindrical ceramic body having axially extending passages therethrough, an annulus of ceramic bordering a cylindrical surface of said body and having a radially extending annular flange bonded to said cylindrical surface of said body at one axial end thereof, there being an annular gap between said ceramic annulus and said cylindrical surface of said body at the other axial end of said body, and an annulus of resilient sealing material in said annular gap.

2. A heat exchanger as set forth in claim 1 wherein said ceramic body and said ceramic annulus have similar coefficients of thermal expansion.

3. A heat exchanger as set forth in claim 1 wherein the length of said gap axially of the body is from about 25% to 50% of the axial length of the body.

4. A heat exchanger as set forth in claim 1 wherein said resilient packing material comprises fibrous ceramic.

5. A heat exchanger as set forth in claim 1 wherein said annulus of ceramic is a rim for said cylindrical body.

6. A heat exchanger as set forth in claim 1 wherein said annulus is a hub for said cylindrical body.

7. A heat exchanger as set forth in claim 1 wherein there is a second said annulus serving as a rim for said cylindrical body.

* * * * *